US011273647B2

(12) United States Patent
Boen et al.

(10) Patent No.: US 11,273,647 B2
(45) Date of Patent: Mar. 15, 2022

(54) PRINT LIQUID SUPPLIES FOR PRINTING DEVICES

(71) Applicant: Hewlett-Packard Development Company, L.P., Spring, TX (US)

(72) Inventors: Bobbi Jean Boen, Vancouver, WA (US); Judson Malcolm Leiser, Corvallis, OR (US); Lynn A. Collie, Vancouver, WA (US); Mark M. Proia, Vancouver, WA (US); Antonio Marquez, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 181 days.

(21) Appl. No.: 16/767,937

(22) PCT Filed: Nov. 8, 2019

(86) PCT No.: PCT/US2019/060509

§ 371 (c)(1),
(2) Date: May 28, 2020

(87) PCT Pub. No.: WO2021/091571

PCT Pub. Date: May 14, 2021

(65) Prior Publication Data

US 2021/0402781 A1 Dec. 30, 2021

(51) Int. Cl.
*B41J 2/175* (2006.01)

(52) U.S. Cl.
CPC ..... *B41J 2/17513* (2013.01); *B41J 2/17523* (2013.01); *B41J 2002/17516* (2013.01)

(58) Field of Classification Search
CPC .. B41J 2/17506; B41J 2/17509; B41J 2/1752; B41J 2/17523; B41J 2/1755; B41J 2002/17516
See application file for complete search history.

(56) References Cited

U.S. PATENT DOCUMENTS

| | | | | |
|---|---|---|---|---|
| 4,074,284 A | | 2/1978 | Dexter et al. | |
| 5,510,820 A | | 4/1996 | Aulick et al. | |
| 5,631,681 A | * | 5/1997 | Klaus | B41J 2/17509 347/85 |
| 5,933,173 A | * | 8/1999 | Solero | B41J 2/17506 347/85 |
| 5,971,532 A | * | 10/1999 | Toda | B41J 2/17506 347/85 |

(Continued)

FOREIGN PATENT DOCUMENTS

| | | |
|---|---|---|
| CN | 1799846 | 7/2006 |
| EP | 2127884 | 12/2009 |

(Continued)

*Primary Examiner* — Anh T Vo
(74) *Attorney, Agent, or Firm* — Hanley Flight & Zimmerman LLC

(57) ABSTRACT

Print liquid supplies for printing devices are disclosed. A print liquid supply includes a container having a wall; a dock connector to enable selective coupling of the print liquid supply with a printing device; and a clamping support structure coupled with the dock connector, the wall of the container clamped therebetween. One of the clamping support structure or the dock connector including a tongue latched onto a groove in the other one of the clamping support structure or the dock connector.

15 Claims, 4 Drawing Sheets

(56) References Cited

U.S. PATENT DOCUMENTS

| | | | | |
|---|---|---|---|---|
| 9,050,814 | B2 | 6/2015 | Yoshida et al. | |
| 2001/0013885 | A1 | 8/2001 | Yamaguchi et al. | |
| 2003/0142176 | A1* | 7/2003 | Wu ..... | B41J 2/17523 347/85 |
| 2004/0036747 | A1 | 2/2004 | Whitlock et al. | |
| 2005/0151800 | A1 | 7/2005 | Kono et al. | |
| 2010/0253736 | A1 | 10/2010 | Silverbrook et al. | |
| 2017/0341395 | A1 | 11/2017 | Toya et al. | |

FOREIGN PATENT DOCUMENTS

| | | |
|---|---|---|
| EP | 3300804 | 4/2018 |
| JP | 2004189276 | 7/2004 |
| WO | 2009139761 | 11/2019 |

* cited by examiner

PRINT LIQUID SUPPLIES FOR PRINTING DEVICES

BACKGROUND

Printing devices operate to dispense a liquid onto a surface of a substrate. These printing devices may include two-dimensional (2D) and three-dimensional (3D) printing devices. In the context of a 2D printing device, a liquid such as an ink may be deposited onto the surface of the substrate such as paper. In the context of a 3D printing device, an additive manufacturing liquid may be dispensed onto the surface of the substrate in order to build up a 3D object during an additive manufacturing process. Often, print liquid is supplied to a printing device from a reservoir or other supply. The print liquid reservoir holds a volume of print liquid that is passed to a liquid deposition mechanism and ultimately deposited on a surface of the substrate.

Figure 1:
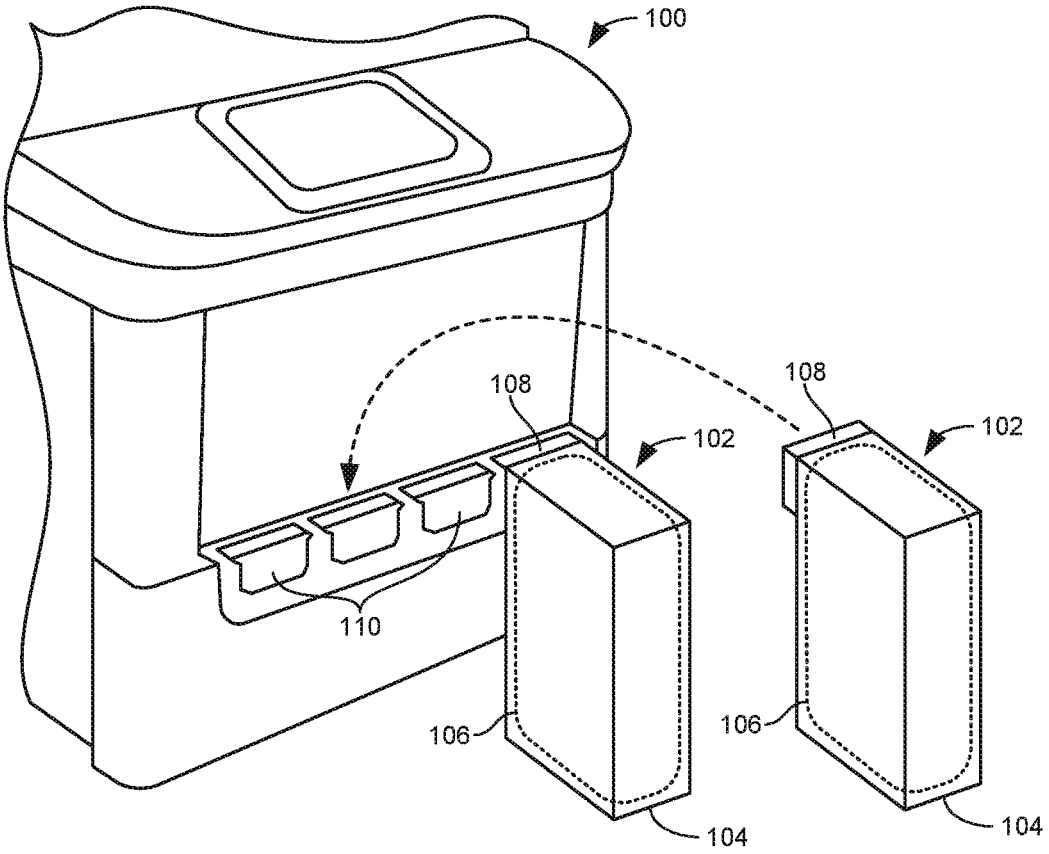
FIG. 1 is a perspective view of an example ink supply dock of a printing device interfacing with example ink supplies constructed in accordance with teachings disclosed herein.

In general, the same reference numbers are used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

Many printing devices include a reservoir or multiple reservoirs of print liquid that are retained internally within such devices to supply print liquid to liquid deposition mechanisms of the printing devices. In some instances, such reservoirs are associated with self-contained print liquid supplies that may be removed and replaced from a printing device once the print liquid contained therein has been used. Reservoirs for print liquid in other printing devices may be internally incorporated into the structure of the printing device in a manner that enables such reservoirs to be refilled or resupplied with print liquid from separate liquid supplies fluidly coupled thereto.

Liquid supplies come in many forms. For example, one such liquid supply is a pliable reservoir (e.g., a plastic bag). Pliable reservoirs can be relatively simple to make at relatively low cost. However, pliable reservoirs themselves are difficult to handle and couple to a printing device. Accordingly, in some examples, a pliable reservoir may be disposed within a container, carton, box, or other similar housing structure to provide some rigidity to the supply, thereby making the supply easier to handle.

FIG. 1 is a perspective view of an example printing device 100 interfacing with example print liquid supplies 102 constructed in accordance with teachings disclosed herein. As shown in the illustrated example, the liquid supplies 102 include an example container, carton, or box 104 with an example pliable reservoir or bag 106 disposed therein to hold print liquid. In some examples, the container 104 is made of corrugated fiberboard (e.g., corrugated cardboard) folded into a box shape as shown. The container may be any suitable size to hold and support a pliable reservoir 106 holding any suitable volume of print liquid.

As shown in FIG. 1, the example liquid supplies 102 include an example supply/printer interface assembly 108 that enables the liquid supply 102 to be attached to and interface with a corresponding example supply dock 110 on an exterior of the printing device 100. More particularly, the supply/printer interface assembly 108 mechanically interfaces with a corresponding supply dock 110 to enable the liquid supply 102 to be supported by and hang from the printing device 100 as shown in the illustrated example. Furthermore, in some examples, the supply/printer interface assembly 108 provides fluid coupling between the pliable reservoir 106 within the container 104 to a fluid channel associated with the supply dock 110 that leads to an internal reservoir of the print device 100. Further, in some examples, the supply/printer interface assembly 108 may establish an electrical connection with electrical connectors in the supply dock 110 to enable the printing device 100 to electrically communicate with electrical components of the liquid supply 102.

Figure 2:
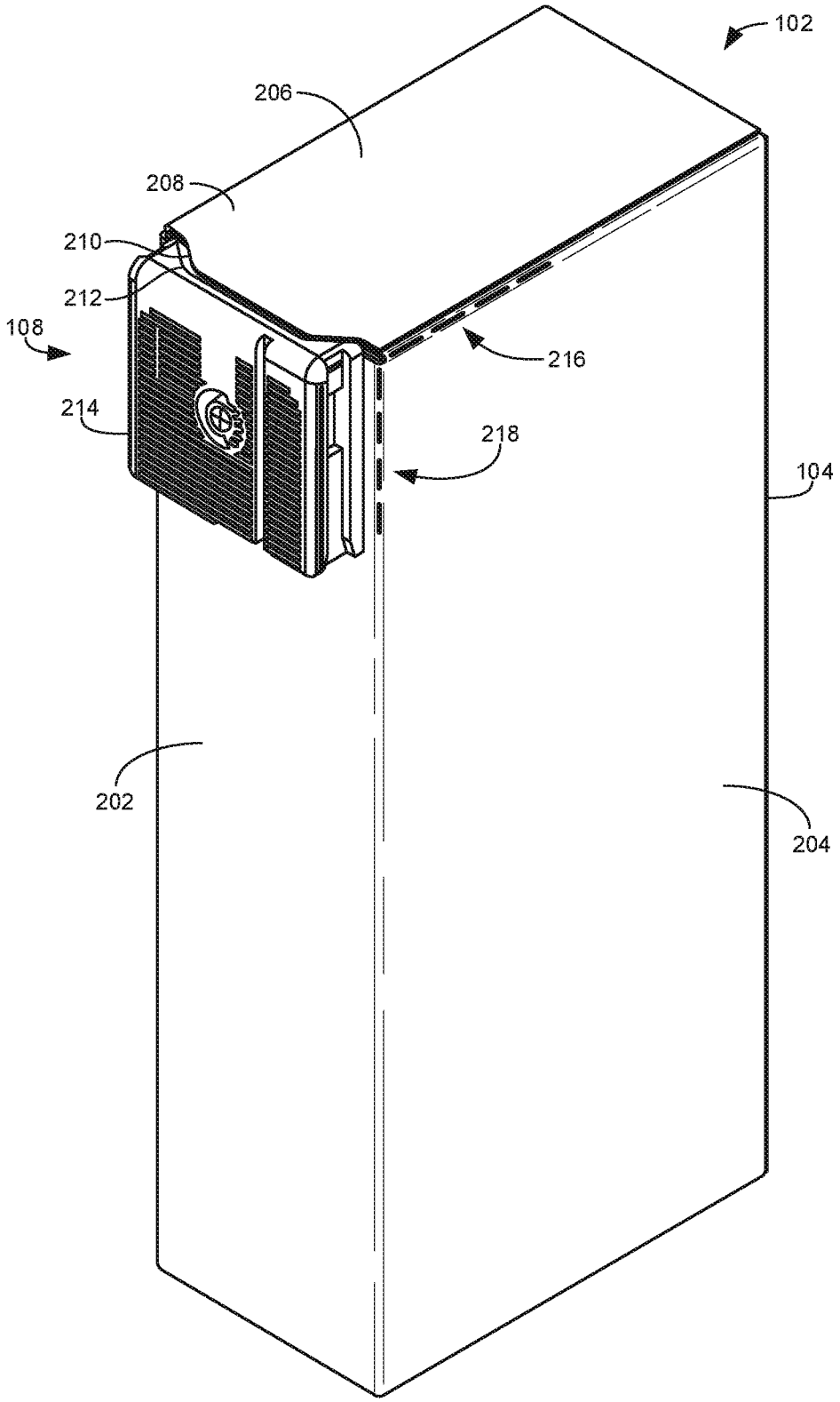
FIG. 2 is a detailed perspective view the example liquid supply 102 of FIG. 1.

FIG. 2 is a detailed perspective view the example liquid supply 102 of FIG. 1. In this example, the container 104 is a cardboard box with an example front face or wall 202, example side walls 204, and an example top wall 206. As shown in the illustrated example, the supply/printer interface assembly 108 is attached to the front wall 202 of the container 104 adjacent the top wall 206. In some examples, the top wall 206 includes an example flap 208 or multiple flaps 208 that may be opened to provide access to the inside of the container 104 to insert the pliable reservoir 106 and attach the supply/printer interface assembly 108. Once the supply/printer interface assembly 108 is installed within the container 104, the flaps 208 may be closed as shown in the illustrated example. In some examples, the flaps 208 include an example tab 210 that fits within an example recess 212 of the supply/printer interface assembly 108.

Figure 3:
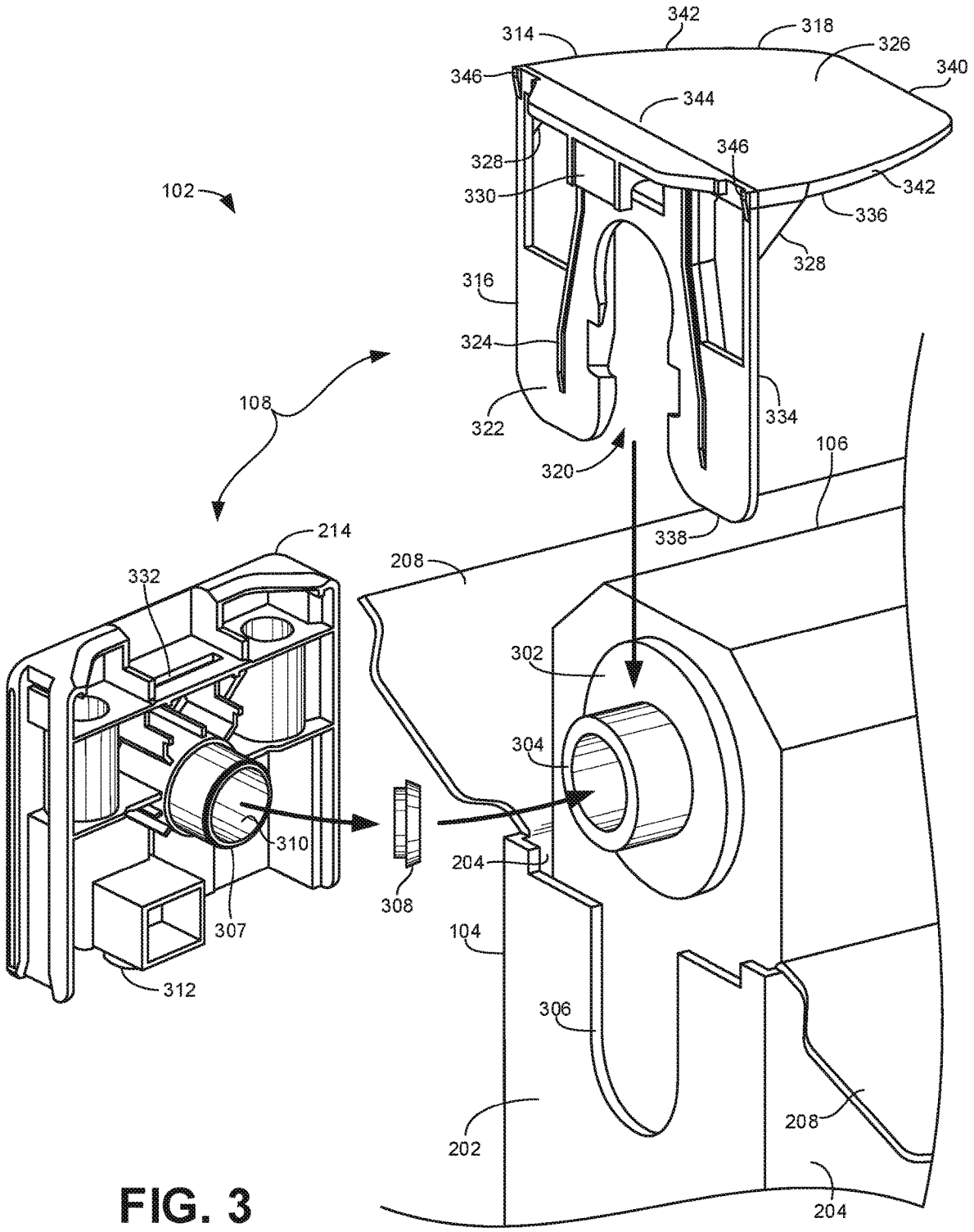
FIG. 3 is an exploded view of a portion of the example liquid supply of FIGS. 1 and 2.
Figure 4:
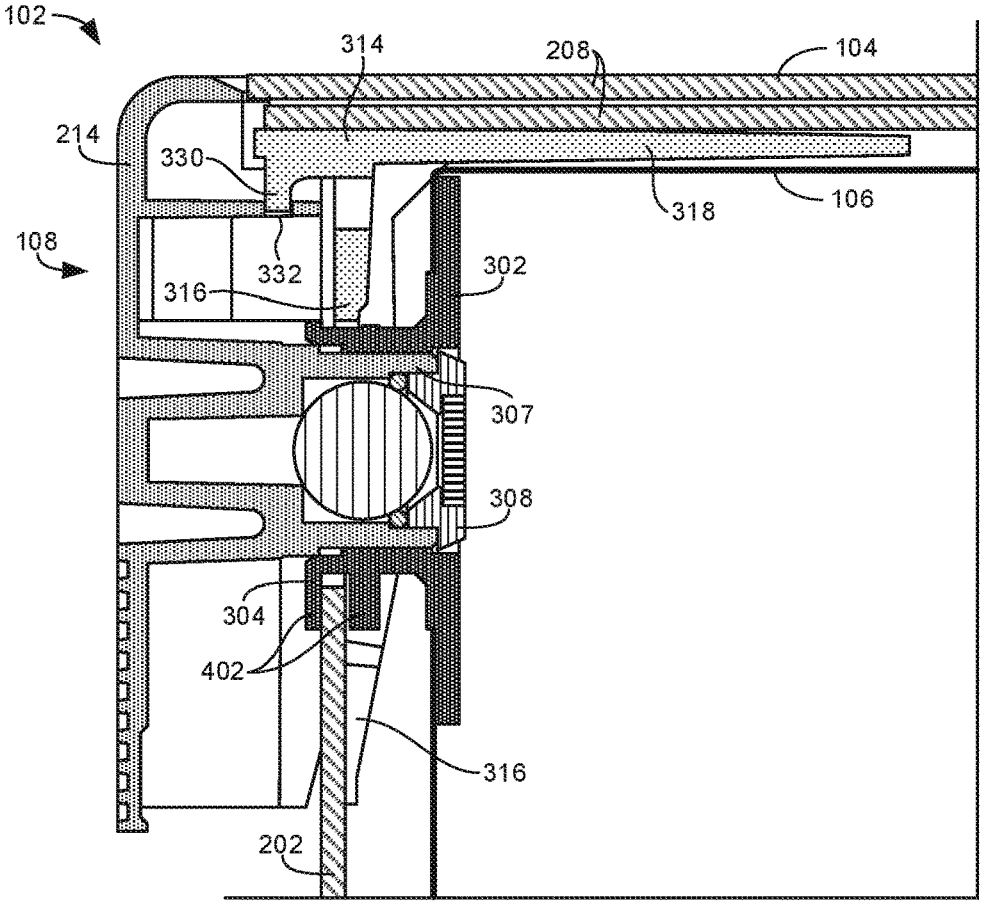
FIG. 4 is a cross-sectional view of a portion of the example liquid supply of FIGS. 1 and 2.

In some examples, the supply/printer interface assembly 108 attaches to the container 104 by clamping, pinching, or compressing the front wall 202 of the container 104 between an example dock connector 214 on the outside of the container 104 and an example clamping support structure 314 on the inside of the container as shown in FIGS. 3 and 4. In particular, FIG. 3 shows the container 104 with the flaps 208 opened, the pliable reservoir 106 partially inserted therein, and some of the main components of the supply/printer interface assembly 108 in an exploded view. FIG. 4 is a cross-sectional view of the liquid supply 102 with the supply/printer interface assembly 108 installed with the flaps 208 of the container closed in a fully assembled condition.

As shown in the illustrated examples, an example spout 302 is affixed to the pliable reservoir 106 with an example protrusion 304 structured to extend through and/or interface with an example opening or slot 306 in the front wall 202 of the container 104. More particularly, in some examples, as shown in FIG. 4, the spout 302 includes example ridges 402 on the protrusion 304 that mate with the front wall 202 of the container 104. The dock connector 214 includes an example reservoir connecting protrusion 307 to facilitate the fluidic connection between the pliable reservoir 106 and the supply dock 110. More particularly, in some examples, the reservoir connecting protrusion 307 interfaces with an example collar 308 and extends through the opening 306 of the front wall 202 of the container 104 and into the protrusion 304 of the spout 302. In some examples, the reservoir connecting protrusion 307 of the dock connector 214 includes an example channel 310 that is in fluid communication with an example outlet 312 at the bottom of the dock connector 214. In some examples, the outlet 312 interfaces with a corresponding inlet on the supply dock 110 to enable the transfer of print liquid from the pliable reservoir 106, through the spout 302 and the dock connector 214, and into the printing device 100.

As shown in FIG. 3, the clamping support structure 314 includes an example clamp plate 316 and an example back plate 318. The clamp plate 316 includes an example slot 320 that fits around and interfaces with protrusion 304 of the spout. More particularly, in some examples, the clamp plate 316 interfaces with the ridges 402 on the spout to urge an example clamping surface 322 of the clamp plate 316 towards the front wall 202 of the container 104, thereby compressing the front wall 202 between the clamp plate 316 and the dock connector 214. Further, in some examples, the clamp plate 316 includes example ribs 324 that protrude out from the clamping surface 322 to press into the front wall 202 of the container 104 to increase the compression grip between the clamp plate 316 and the dock connector 214. The back plate 318 of the example clamping support structure 314 includes an example support surface 326 on its upper side that interfaces with the flaps 208 that correspond to the top wall 206 of the container 104 once closed. In some examples, the clamping support structure 314 includes example gussets 328 on either side of the clamping support structure 314 to provide structural support between the clamp plate 316 and the back plate 318.

During a refill operation, the example liquid supply 102 is attached to a corresponding supply dock 110, as shown in the illustrated example of FIG. 1, and the printing device 100 pumps print liquid from within the supply 102 to an internal reservoir within the printing device 100. In some examples, once the refill operation has been initiated, the supply 102 may be left unattended until the refill operation is complete, at which point the supply 102 may be removed from the supply dock 110. As such, refilling the internal reservoirs of the printing device 100 is relatively quick and easy. While the precise duration of a refill operation may vary depending on the amount of print liquid to be resupplied to the printing device, the duration is typically relatively short (e.g., completed in a matter of minutes). Although the duration of a refill operation is relatively short, during that period of time, the liquid supply 102 protrudes out from an external face of the printing device 100, which could create a situation where a person and/or object may bump into the supply 102 while moving in the vicinity of the printing device 100.

If an impact on the liquid supply 102 is of sufficient force, there is a risk that the liquid supply 102 may be damaged and possibly detach from the supply dock 110. More particularly, in some examples, an impact on the side of the liquid supply 102 may cause the container 104 to tear away from the dock connector 214 that is mechanically secured within a supply dock 110. In some situations, as the container 104 breaks apart from the dock connector 214, the container 104 may pull on the clamping support structure 314 so that the clamping support structure 314 also separates from the dock connector 214. The separation of the clamping support structure 314 from the dock connector 214 in this manner may cause the pliable reservoir 106 to tear and/or otherwise separate from the dock connector 214. Separation of the pliable reservoir 106 from the dock connector 214 (by tearing or otherwise) gives rise to the potential for spillage of print liquid contained within the reservoir. Examples disclosed herein reduce the likelihood of spillage relative to other similar liquid supplies by (1) increasing the strength of connection between the dock connector 214 and the clamping support structure 314, and/or (2) reducing (e.g., decoupling) the connection between the clamping support structure 314 and the container 104, and/or (3) facilitating and/or inducing the tearing of the walls of the container 104 during an impact to provide for quick separation of the container from the other components of the liquid supply 102. Achieving these objectives enables the container 104 to tear during an impact without pulling out the clamping support structure or tearing the pliable reservoir 106 contained therein. While this results in a torn container 104, a spillage is avoided because the print liquid remains contained within the pliable reservoir 106, which remains sealingly coupled to the supply/printer interface assembly 108.

In some examples, the dock connector 214 and the clamping support structure 314 are secured to one another by a tongue-and-groove connection that is separate and spaced apart from the reservoir connecting protrusion 307 of the dock connector 214. Specifically, as shown in the illustrated example, the clamping support structure 314 includes an example tongue or tab 330 that is positioned to engage and/or interlock with an example groove or slot 332 in the dock connector 214. In some examples, the tongue 330 may be positioned on the dock connector 214 with the groove 332 in the clamping support structure 314. Further, in some examples, there may be multiple tongues 330 and multiple corresponding grooves 332 to further increase the strength of connection between the dock connector 214 and the clamping support structure 314. As shown in FIG. 4, in some examples, the tongue 330 and the groove 332 is the sole location where the dock connector 214 and the clamping support structure 314 directly contact one another. Aside from the tongue-and-groove connection, the dock connector 214 and the clamping support structure 314 are separated by the front wall 202 and are indirectly coupled through interference and/or compression fittings via the spout 302. Thus, the tongue-and-groove connection provides a direct mechanical interlock of the dock connector 214 and the clamping support structure 314, which can significantly increase the strength of connection between the components.

As mentioned above, the gussets 328 provide structural support between the clamp plate 316 and the back plate 318. As shown in FIG. 3, the gussets 328 are positioned on either side of the clamping support structure 314, which places the gussets 328 adjacent the side walls 204 of the container 104 when installed therein. As a result, movements of the walls 204 of the container 104 (e.g., due to the container being bumped from the side) can translate into movement of the gussets 328 and, thus, the entire clamping support structure 314. The force of such movement can contribute to the separation of the clamping support structure 314 from the dock connector 214. Accordingly, in some examples, the gussets 328 are relatively small. More particularly, in some examples, the distance that the gussets 328 extend down the backside 334 of the clamp plate 316 is less than half the distance from the underside 336 of the back plate 318 to a bottom edge 338 of the clamp plate 316. Similarly, in some examples, the distance that the gussets 328 extend along the back plate 318 is less than half the distance from the backside 334 of the clamp plate 316 to a back edge 340 of the back plate 318. In some examples, the gussets 328 extend along the clamp plate 316 and/or the back plate 318 significantly less than half (e.g., less than ⅓, ¼, ⅕, 1/10, etc.) the length of the respective plates. The relatively small size of the gussets 328 serves to reduce forces acting on the container 104 from being translated to the clamping support structure 314.

Figure 5:
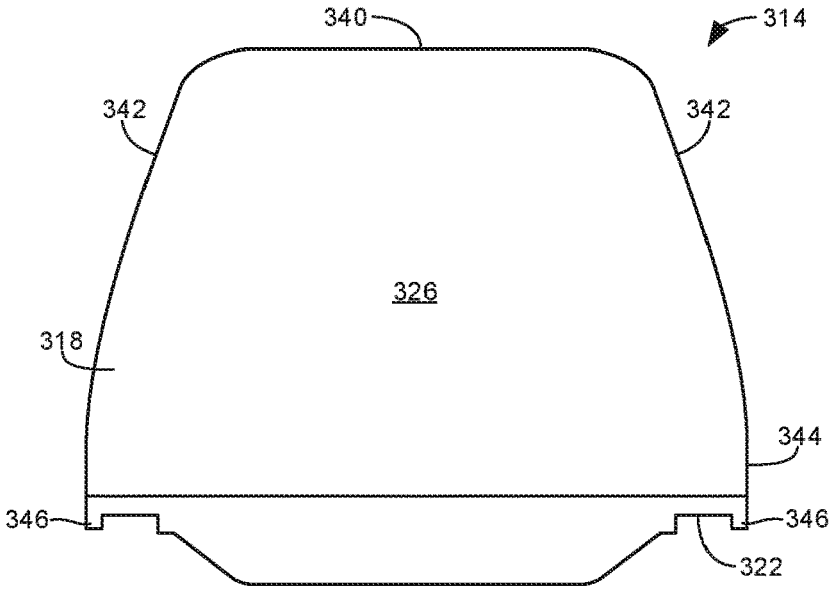
FIG. 5 is a top view of the example clamping support structure shown in FIGS. 3 and 4.

In some examples, the back plate 318 is shaped to also reduce forces acting on the container 104 from being translated to the clamping support structure 314. In particular, as shown in the illustrated example, the back plate 318 includes example side edges 342 that narrow towards the back edge 340 when compared with a widest region of the back plate 318 at a front portion 344 adjacent the clamp plate 316. That is, the side edges 342 are angled towards one another as get closer together as the distance from the clamp plate 316 increases. This is shown more clearly in FIG. 5, which is a top view of the clamping support structure 314. As shown in FIG. 5, the width of the back edge 340 of the back plate 318 is less than the width of the front portion 344 of the back plate 318 (which, in this example, has the same width as the clamp plate 316). In some examples, the width of the back edge 340 is less than ¾ the width of the front portion 344 of the back plate 318. In other examples, the width of the back edge may be greater or smaller when compared to the width of the front edge.

The narrowing side edges 342 of the back plate 318 create a gap between the side walls 204 of the container 104 along a substantial length of the back plate 318. As a result, if a force hits the side of the container 104, the container 104 deforms and bends before the container 104 contacts the full length of the side edges 342 of the back plate 318. Therefore, there is less likelihood that a side impact to the container 104 translates into movement of the clamping support structure 314 as compared to designs where the back plate 318 is rectangular with straight side edges that run along the inner surface of the side walls 204 of the container 104.

In some examples, the side edges 342 of the back plate 318 have a curvilinear profile extending between the front portion 344 of the back plate 318 and the back edge 340. Curving or rounding the edges 342 in this manner further reduces the effect of the container 104 being subject to a side impact. In particular, as the side wall 204 of the container 104 is pushed against the side edge 342 of the back plate 318, the side wall 204 does not press against the full length of the side edge 342 in a single instant. Rather, the side wall first contacts the side edge 342 near the clamp plate 316 and moving backwards along the side edge 342 as the side wall 204 of the container 104 is pushed farther to the side and into the back plate 318.

As mentioned above, in some examples, the container 104 is made of a paper-based substrate such as, for example, cardboard. Cardboard can deform up to a point before it tears. In some examples, the curvilinear shape of the side edges 342 of the back plate 318 facilitates the tearing or failure of the container 104 before the container is able to pull the clamping support structure 314 away from the dock connector 214. More particularly, in some examples, the side edges 342 of the back plate 318 work in conjunction with lines of weakness such as, for example, perforations 216 adjacent the edge of the container 104 between the top and side wall 204, 206 as shown in FIG. 2. In some examples, the perforations 216 may be on the flaps 208 and/or the side walls 204. In some examples, the container 104 may be considerably wider than the width of the supply/printer interface assembly 108 such that the side walls 204 are spaced apart from the side edges 342 of the back plate 318. In such examples, the perforations 216 may also be spaced apart from the side walls 204 and in the top wall 206 in proximity to the side edges 342 of the back plate 318.

The perforations 216 provide a point of weakness in the container 104 at the position corresponding to the location of the back plate 318. As a result, if the container 104 is hit from the side and forced into the clamping support structure 314, the side edge 342 of the back plate 318 pushes through and breaks the perforation, thereby enabling the container 104 to break free without taking the clamping support structure 314 or the pliable reservoir 106 with it. Rather, the container 104 tears and separates from the supply/printer interface assembly 108 that remains intact (with the dock connector 214 remaining connected to the clamping support structure 314 and remaining sealingly engaged with the pliable reservoir 106). As mentioned above, the curvilinear nature of the side edges 342 facilitate the tearing of the container 104 along the perforations 216 because the side wall 204 contacts solely a portion of the curved edge at any given point in time as the side wall 204 is forced against the back plate 318. As a result, the force is localized to increase the ability to cause the container 104 to tear along the perforations 216.

Additionally or alternatively, in some examples, the container 104 may include lines of weakness such as, for example, perforations 218 adjacent the edge of the container 104 between the front and side walls 202, 204 as shown in FIG. 2. In some examples, the perforations 218 may be on the front wall 202 and/or the side walls 204. As mentioned above, in some examples, the container 104 may be considerably wider than the width of the supply/printer interface assembly 108 such that the side walls 204 are spaced apart from the sides of the clamp plate 316. In such examples, the perforations 218 may also be spaced apart from the side walls 204 and in the front wall 202 in proximity to the sides of the clamp plate 316. The perforations 218 adjacent the sides of the clamp plate 316 provide another point of weakness in the container 104 surrounding the supply/printer interface assembly 108 to enable the container to separate from the supply/printer interface assembly 108 without pulling away any of the components which may give rise to a risk of spilling print liquid. In some examples, additional perforations may extend across the front wall 202 of the container 104 in an area proximate to the bottom edge 338 of the clamp plate 316 and/or extend across the top wall 206 in an area proximate the back edge 340 of the back plate 318.

In some examples, to facilitate, initiate, and/or induce tearing along the perforations 218, the clamping support structure 314 includes an example protrusion 346 or multiple protrusions 346 on the clamping surface 322 that are positioned to generally align with the perforations 218. Inasmuch as the protrusions 346 extend outward from the clamping surface 322, which is itself pressed against the inner surface of the front wall 202, the protrusions 346 press into the front wall 202. As a result, the protrusions 346 create a stress point that can facilitate the initiation of tearing of the container 104 along the perforations 218. Although the above example is described in connection with the perforations 218, in some examples, the protrusions 346 may additionally or alternatively be located at other locations on the supply/printer interface assembly 108 to align with other perforations in the container 104. Further, in some examples, the protrusions 346 may be implemented as spaced apart from perforations in the container 104 and/or without perforations in the container 104.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one entity or multiple ones of that entity. The terms "a" (or "an") and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

Example apparatus and articles of manufacture are disclosed that enable a print liquid supply with a supply/printer interface assembly that enables the external mounting of the supply to a printing device with a construction that reduces the risk of a liquid spillage in the event the supply is hit or bumped. Reducing (e.g., avoiding) the spillage of liquid is accomplished by reducing the likelihood that the container of the supply, when hit from the side, pulls on and/or causes the separation of internal components of the supply/printer interface assembly from the external components of the assembly mechanically coupled to the printing device. As a result, while the container may tear and/or break away from the supply/printer interface assembly due to an side impact, the supply/printer interface assembly retains a seal on the pliable reservoir within the container holding the print liquid. Therefore, a spillage of the liquid is averted.

Example print liquid supplies for printing devices are disclosed herein. Further examples and combinations thereof include the following:

Example 1 includes a print liquid supply comprising a container having a wall, a dock connector to enable selective coupling of the print liquid supply with a printing device, and a clamping support structure coupled with the dock connector, the wall of the container clamped therebetween, one of the clamping support structure or the dock connector including a tongue latched onto a groove in the other one of the clamping support structure or the dock connector.

Example 2 includes the print liquid supply of example 1, further including a pliable reservoir within the container, the reservoir to hold print liquid, the dock connector including a reservoir connecting protrusion extending into the container, the reservoir coupled to the reservoir connecting protrusion, the tongue and the groove spaced apart from the reservoir connecting protrusion.

Example 3 includes the print liquid supply of example 1, wherein at least a portion of the container is made of corrugated fiberboard and includes perforations adjacent at least one of the dock connector or the clamping support structure, the perforations to facilitate tearing of the container in response to an impact.

Example 4 includes the print liquid supply of example 1, wherein the wall of the container is a first wall, the container including a second wall extending substantially perpendicular to the first wall, the clamping support structure including a clamp plate having a clamping surface engaging the first wall of the container when the clamping support structure is disposed within the container, and a back plate having a support surface engaging the second wall when the clamping support structure is disposed within the container.

Example 5 includes the print liquid supply of example 4, wherein the clamping support structure includes a gusset extending between the clamp plate and the back plate, the gusset extending a first distance along the back plate that is less than half a second distance from a back side of the clamp plate to a back edge of the back plate.

Example 6 includes the print liquid supply of example 4, wherein the clamping support structure includes a protrusion on the clamping surface, the protrusion extending toward the first wall of the container to create a stress point on the wall to induce tearing of the container in response to an impact.

Example 7 includes the print liquid supply of example 6, wherein the protrusion is proximate a perforation in the container.

Example 8 includes the print liquid supply of example 4, wherein the back plate includes a front portion adjacent the clamp plate and a back edge spaced apart from the clamp plate, the back edge having a first width, the front portion having a second width, the first width less than the second width.

Example 9 includes the print liquid supply of example 8, wherein the back plate includes side edges extending between the front portion and the back edge of the back plate, the side edges having a curvilinear profile.

Example 10 includes an apparatus comprising a clamping support structure to be housed within a box for a print liquid supply, and a dock connector to be carried on an exterior of the box to enable selective coupling of the print liquid supply with a printing device, the dock connector to be coupled to the clamping support structure with a wall of the box clamped therebetween, one of the clamping support structure or the dock connector including a tab to engage a slot in the other one of the clamping support structure or the dock connector.

Example 11 includes the apparatus of example 10, wherein the clamping support structure includes a back plate to extend away from the wall of the box, the back plate including side edges that are angled towards one another as the side edges extend towards a back edge of the back plate.

Example 12 includes the apparatus of example 10, wherein the clamping support structure includes a clamp plate to be urged towards the dock connector to clamp the wall of the box, a back plate to extend away from the wall of the box, and a gusset providing support between the clamp plate and the back plate, the gusset extending along the clamp plate by less than a third of a length of the clamp plate.

Example 13 includes the apparatus of example 10, wherein the clamping support structure includes a protrusion to press into the wall of the box clamped between the clamping support structure and the dock connector, the protrusion to extend toward the wall of the box to create a stress point on the wall to facilitate initiation of tearing of the box in response to an impact.

Example 14 includes a print liquid supply comprising a corrugated fiberboard container, a dock connector to enable selective coupling of the print liquid supply with a printing device, the dock connector positioned on a first side of a wall of the container, and a clamping support structure positioned on a second side of the wall opposite the first side, the clamping support structure directly mechanically interlocked with the dock connector via a tongue-and-groove connection.

Example 15 includes the print liquid supply of example 14, wherein the container includes perforations adjacent at least one of the dock connector or the clamping support structure to facilitate tearing of the container in response to an impact.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate example of the present disclosure.

What is claimed is:

1. A print liquid supply comprising:

a container having a wall;

a dock connector to enable selective coupling of the print liquid supply with a printing device; and a clamping support structure coupled with the dock connector, the wall of the container clamped therebetween, one of the clamping support structure or the dock connector including a tongue latched onto a groove in the other one of the clamping support structure or the dock connector.

2. The print liquid supply of claim 1, further including a pliable reservoir within the container, the reservoir to hold print liquid, the dock connector including a reservoir connecting protrusion extending into the container, the reservoir coupled to the reservoir connecting protrusion, the tongue and the groove spaced apart from the reservoir connecting protrusion.

3. The print liquid supply of claim 1, wherein at least a portion of the container is made of corrugated fiberboard and includes perforations adjacent at least one of the dock connector or the clamping support structure, the perforations to facilitate tearing of the container in response to an impact.

4. The print liquid supply of claim 1, wherein the wall of the container is a first wall, the container including a second wall extending substantially perpendicular to the first wall, the clamping support structure including:

a clamp plate having a clamping surface engaging the first wall of the container when the clamping support structure is disposed within the container; and a back plate having a support surface engaging the second wall when the clamping support structure is disposed within the container.

5. The print liquid supply of claim 4, wherein the clamping support structure includes a gusset extending between the clamp plate and the back plate, the gusset extending a first distance along the back plate that is less than half a second distance from a back side of the clamp plate to a back edge of the back plate.

6. The print liquid supply of claim 4, wherein the clamping support structure includes a protrusion on the clamping surface, the protrusion extending toward the first wall of the container to create a stress point on the wall to induce tearing of the container in response to an impact.

7. The print liquid supply of claim 6, wherein the protrusion is proximate a perforation in the container.

8. The print liquid supply of claim 4, wherein the back plate includes a front portion adjacent the clamp plate and a back edge spaced apart from the clamp plate, the back edge having a first width, the front portion having a second width, the first width less than the second width.

9. The print liquid supply of claim 8, wherein the back plate includes side edges extending between the front portion and the back edge of the back plate, the side edges having a curvilinear profile.

10. An apparatus comprising:

a clamping support structure to be housed within a box for a print liquid supply; and a dock connector to be carried on an exterior of the box to enable selective coupling of the print liquid supply with a printing device, the dock connector to be coupled to the clamping support structure with a wall of the box clamped therebetween, one of the clamping support structure or the dock connector including a tab to engage a slot in the other one of the clamping support structure or the dock connector.

11. The apparatus of claim 10, wherein the clamping support structure includes a back plate to extend away from the wall of the box, the back plate including side edges that are angled towards one another as the side edges extend towards a back edge of the back plate.

12. The apparatus of claim 10, wherein the clamping support structure includes:

a clamp plate to be urged towards the dock connector to clamp the wall of the box;

a back plate to extend away from the wall of the box; and a gusset providing support between the clamp plate and the back plate, the gusset extending along the clamp plate by less than a third of a length of the clamp plate.

13. The apparatus of claim 10, wherein the clamping support structure includes a protrusion to press into the wall of the box clamped between the clamping support structure and the dock connector, the protrusion to extend toward the wall of the box to create a stress point on the wall to facilitate initiation of tearing of the box in response to an impact.

14. A print liquid supply comprising:

a corrugated fiberboard container;

a dock connector to enable selective coupling of the print liquid supply with a printing device, the dock connector positioned on a first side of a wall of the container; and a clamping support structure positioned on a second side of the wall opposite the first side, the clamping support structure directly mechanically interlocked with the dock connector via a tongue-and-groove connection.

15. The print liquid supply of claim 14, wherein the container includes perforations adjacent at least one of the dock connector or the clamping support structure to facilitate tearing of the container in response to an impact.

* * * * *